United States Patent [19]

Mitchell

[11] 4,264,182

[45] Apr. 28, 1981

[54] ELECTROGRAPHIC APPARATUS HAVING IMPROVED DEVELOPMENT STRUCTURE

[75] Inventor: John D. Mitchell, Webster,, N.Y.

[73] Assignee: Eastman Kodak Company, Rochester, N.Y.

[21] Appl. No.: 37,602

[22] Filed: May 10, 1979

[51] Int. Cl.[3] ..... G03G 15/00

[52] U.S. Cl. ..... 355/3 DD; 118/657; 118/661; 355/16

[58] Field of Search ..... 355/3 R, 3 DD, 14 D, 355/16; 118/653, 656, 657, 658, 661; 354/318; 352/130

[56] References Cited

U.S. PATENT DOCUMENTS

| | | | |
|---|---|---|---|
| 3,596,635 | 8/1971 | Smitzer | 118/661 X |
| 3,816,114 | 6/1974 | Fukushima et al. | 118/661 X |
| 3,922,380 | 11/1975 | Rowell et al. | 355/3 DD X |
| 4,013,041 | 3/1977 | Armstrong et al. | 118/656 |

OTHER PUBLICATIONS

Davidson, James R; "Development Roll Spacer;" Xerox Disclosure Journal; May 1976; vol. 1, No. 5, p. 35.

Davidson, J. R., "Color Xerography With Intermediate Transfer;"Xerox Disclosure Journal; Jul. 1976; vol. 1, No. 7, p. 29.

*Primary Examiner*—Fred L. Braun
*Attorney, Agent, or Firm*—John D. Husser

[57] ABSTRACT

An electrographic development apparatus, particularly suited for single component developer, provides an electrographic imaging member mounted in a tensioned condition along the apparatus path in a manner causing a substantial normal force between that member and the opposing portion of a developer applicator. Drive transmission structure of the applicator and the image member maintains nominal member spacing and minimizes relative movement of the members to facilitate development under such biased relation.

12 Claims, 6 Drawing Figures

ELECTROGRAPHIC APPARATUS HAVING IMPROVED DEVELOPMENT STRUCTURE

BACKGROUND OF THE INVENTION

1. Field of the Invention

The present invention relates to the development of electrographic images and more particularly to electrographic apparatus having an improved configuration for developing such images with single component developer.

2. Description of Prior Art

The use of an applicator member is a well known technique for developing an electrographic image member with dry toner particles. In general this technique involves the attracting of successive quantities of developer to the applicator and transporting the attracted developer into a transfer relation with successive portions of the image member. Magnetic brushes are a common form for such applicator members and usually have a cylindrical periphery on which developer is transported. Magnetic brushes are useful with single-component developer, wherein the toner is itself magnetic, and with multicomponent developers, wherein a magnetic carrier such as iron particles is utilized in mixture with the toner.

In most, if not all, development systems using applicator members, it is highly desirable to maintain certain nominal development conditions at the transfer interface, i.e., the zone between the developer and the image member. An important one of these nominal conditions is the spacial relation of the image member and the toner on the applicator; however, due to the dynamic nature of applicator development systems, a nominal spacial relation is quite difficult to maintain. If nominal spacing is not positively maintained, a temporary decrease in developer on the applicator can cause incomplete development. However, when nominal spacing is positively maintained, a temporary increase in developer on the applicator can cause image smearing and/or photoconductor abrasion.

U.S. Pat. No. 4,013,041 has disclosed an approach for alleviating these problems in plain paper copiers which have reusable image members. Specifically, the photoconductor is passed over the development zone in a slackened condition and under control of guide means so as to "float" with dynamic changes at the photoconductor-applicator interface. However, even more positive control of the spacing would be desirable. In copiers wherein the copy sheet is itself developed, another effective technique is available for maintaining the image member in contact with the developer. Specifically, the beam strength of the paper copy sheet is used to bias its image surface against the toner applicator. This approach is not readily available, however, in plain paper copiers of the type wherein the reusable image member must move repeatedly around a fixed copying path for development and transfer of successive toner images.

SUMMARY OF THE INVENTION

The present invention pertains to the problems outlined above and provides an improved development structure for plain paper copiers, which is uniquely tailored for use with developer systems which do not require substantial relative velocities between the developer and the photoconductor, e.g., single-component developer systems.

Thus, it is an object of the present invention to provide, in electrographic apparatus, improved configurations and techniques for maintaining nominal spacial relation between the image member and the developer.

The above and other objects and advantages are achieved according to the present invention by providing in such apparatus: (1) an image member having an imaging surface and a drive transmission portion that are movable along an operative path past a development station, (2) a toner applicator member having a toner transport surface and a drive transmission portion that are located in operative relation with said image member, (3) means for resiliently urging one of said image and applicator members toward the other and (4) means for driving one of said members. By this structural arrangement, a nominal spacial relation is positively maintained between the image member and applicator member and said surfaces move through said development zone with substantially zero relative velocity.

BRIEF DESCRIPTION OF THE DRAWINGS

The subsequent description of preferred embodiments of the invention is made with reference to the attached drawings which form a part hereof and in which.

DETAILED DESCRIPTION OF THE PREFERRED EMBODIMENTS

Figure 1:
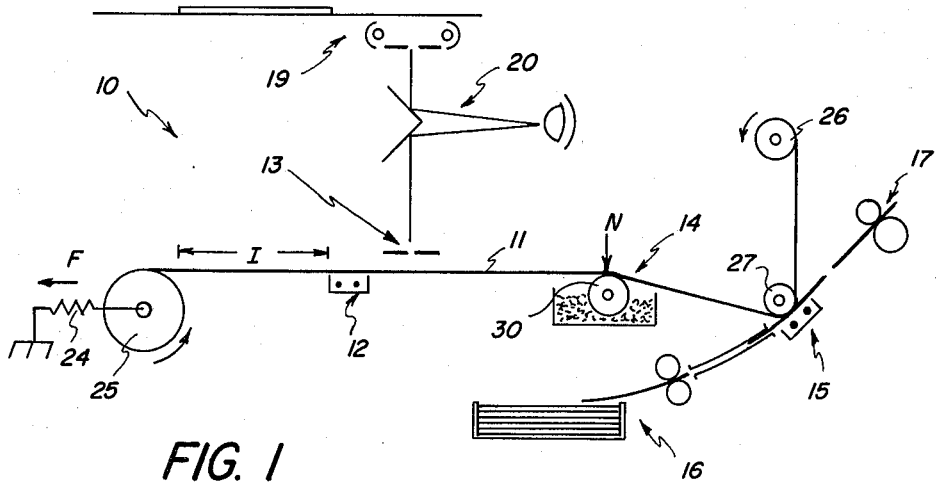
FIG. 1 is a schematic illustration of electrographic apparatus which incorporates one embodiment of the present invention.

Referring to FIG. 1 there is shown schematically an electrophotographic copier 10 in which the present invention is embodied. It is to be noted, however, that the present invention is not limited in application to this specific type of electrographic apparatus, but can be used advantageously in various other apparatus.

The apparatus 10 can utilize a belt-type image member 11, such as a photoconductor, and can comprise a corona charging sation 12 that places a uniform primary charge on the photoconductor, an exposure station 13 at which imagewise discharge of the photoconductor is effected, a development station 14 where toner particles are applied by magnetic brush 30 to the latent electrostatic image, a transfer station 15 where the toner image is transferred to paper, fed from supply 16, and a fixing station 17 where the toner image is affixed to the copy sheet. The stationary original to be copied can be exposed upon the photoconductor by moving a catadioptic lens and mirror system 20 so that successive strip portions are illluminated by lamp assembly 19 and projected onto successive strip portions of the stationary photoconductor 11.

Figure 2:
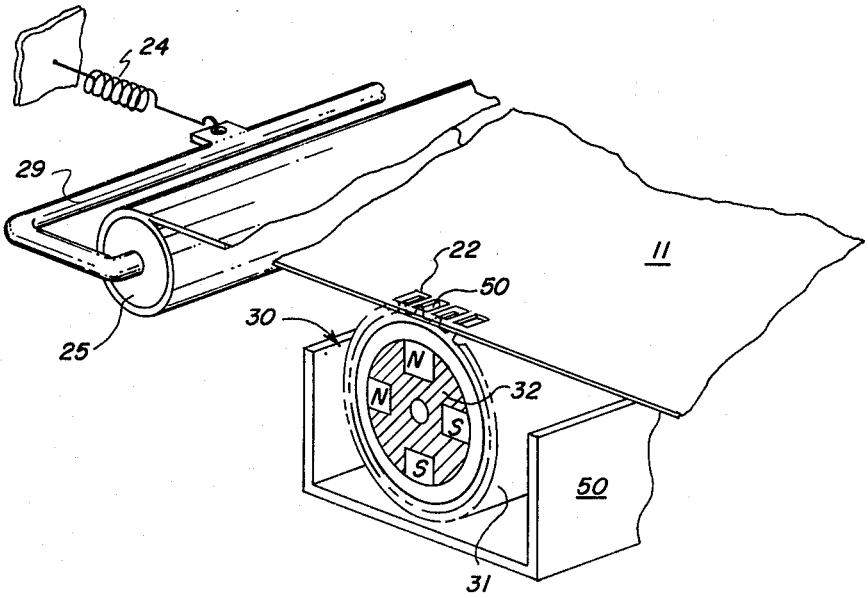
FIG. 2 is an enlarged perspective view of portions of the apparatus shown in FIG. 1.
Figure 3A:
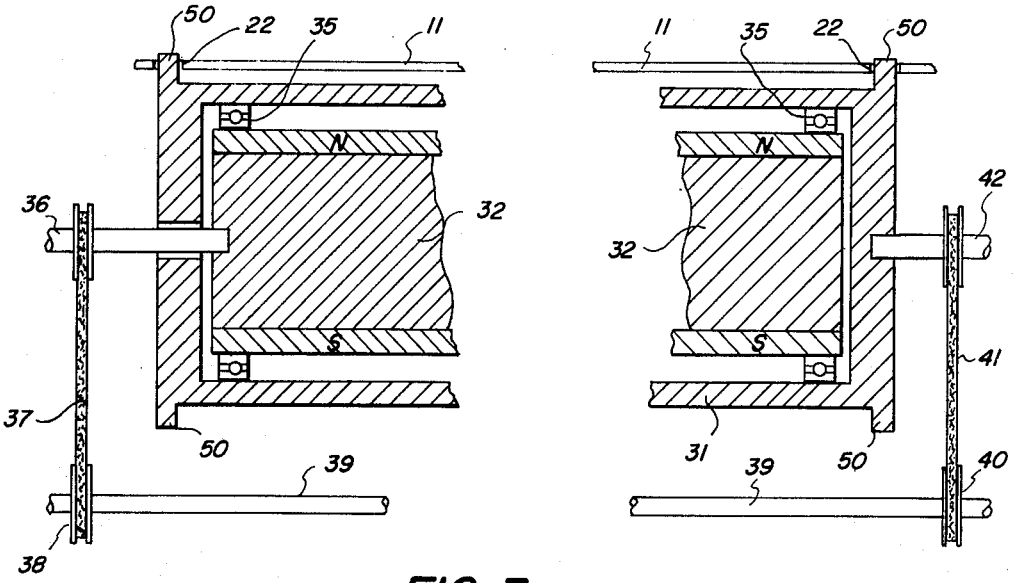
FIG. 3*a* is a partial cross-sectional view of apparatus shown in FIG. 2.

Referring now to FIGS. 2 and 3*a*, as well as FIG. 1, it will be noted that the photoconductor 11 has a series of sprocket holes 22 along the edge portion and that the photoconductor is urged into contact with magnetic brush 30 by a spring 24 which biases the photoconductor supply roller 25 to tension the photoconductor. The photoconductor supply and take-up rollers 25 and 26 can be of a "window shade" type, having spring bias in the directions shown by the arrows in FIG. 1. The details of rollers 25 and 26 are not illustrated but they can be of conventional construction, e.g., such as disclosed in U.S. Pat. Nos. 3,807,854; 3,843,252 or 3,861,613. With this arrangement, image area(s) of the photoconductor 11 can be translated past the electrographic stations of the apparatus 10 and returned for subsequent use.

In general, the machine configuration shown in FIG. 1 is not critical to the invention. Other photoconductor transport systems, e.g., an endless photoconductor belt system, can be utilized. However, in accordance with one desirable feature of the present invention, the belt transport system is configured so that the photoconductor is urged toward the toner applicator, preferably by a precisely controlled resilient force. In the illustrated embodiment this is accomplished, utilizing a component of spring force F, by locating a constraint roller 27 below the direction of force F. By this arrangement the tension force on the photoconductor provides a downward force component N between applicator 30 and photoconductor 11. An equivalent result can be obtained by many other configurations, e.g., by locating roller 27 directly along the direction of tension force F and shifting the location of the applicator upwardly. In another alternative geometry the spring force F could be omitted on the photoconductor and separate means provided for resiliently urging magnetic brush 30 toward the photoconductor.

Referring particularly to FIGS. 1 and 2, another desirable feature of the present invention can be noted. It has been found advantageous for the photoconductor to be provided a degree of freedom to flex torsionally (i.e., to twist slightly about an axis parallel to its length); this allows the photoconductor portion over the applicator to tilt about such axis, e.g., in response to transverse thickness variations of the toner nap. This can be accomplished by locating one end constraint a substantial distance from the zone of contact with brush 30 and/or by mounting a supply or take-up roller to facilitate this movement (e.g., such as with yoke 29 which can rotate on such a parallel axis). Having described several preferred arrangements for mounting image members according to the present invention, exemplary configurations of toner applicators which cooperate therewith are next described below.

Referring to FIGS. 2 and 3*a* it can be seen that magnetic brush 30 comprises a thin cylindrical outer shell 31 constructed, e.g., from aluminum or other non-magnetic material, and mounted for rotation around an inner core 32. The inner core can be formed of iron or other ferromagnetic material and is provided with a series of permanent strips, e.g., rubber-bonded barium ferrite strips, located around its periphery. The inner core 32 also can be mounted for rotation about its central axis, independently from outer shell 31. One means for facilitating such independent rotation can be seen in FIG. 3*a* and comprises bearing rings 35 supporting the two cylinders in spaced relation. Shaft 36 provides drive directly to inner core 32 and, via drive transmission elements 37–42, also to the opposite end of the outer shell 31. Thus the core 32 and outer shell can be driven at different, predetermined speeds. As shown in FIGS. 2 and 3*a* the ends of outer shell 31 are provided with sprocket or gear teeth located around their periphery so as to mesh in drive transmission relation with the sprocket holes 22 formed along the edges of photoconductor 11. The purpose of such drive transmission structure will become clear in consideration of the subsequent description of the operation of electrographic apparatus 10.

Thus, at the commencement of a copy cycle an uncharged image area I of the photoconductor is located with its right edge (as viewed in FIG. 1) adjacent the charging station 12. The charging station 12 and exposure elements 20 are coupled for synchronous leftward movement so that the image area first will receive a uniform electrostatic charge and then be imagewise discharged during exposure at station 13. To develop the resulting electrostatic latent image the images will next be moved over development station 30. During the copy cycle the outer shell 31 and inner core 32 of the magnetic brush are rotated clockwise by drive to shaft 36. As previously described, the photoconductor is urged toward the outer shell 31 by a component of tension force F. The photoconductor thus rests in firm engagement with the outer shell 31 under positive positioning dictated by cooperation of teeth 50 with sprocket holes 22.

Figure 5:
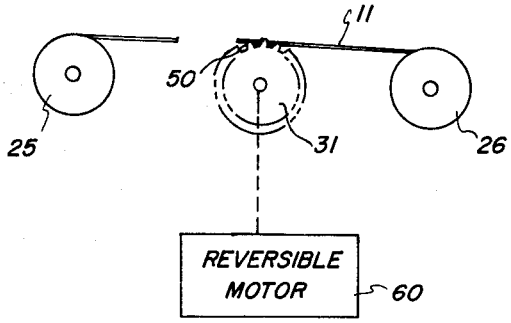
FIG. 5 is a schematic illustration of an alternative drive means for use in the present invention.

The above-described result can be effected, for example as shown in FIGS. 2 and 5, by utilizing the rotation of outer shell 31 to advance the photoconductor during the imaging cycle. Thus reversible motor 60 rotates the outer shell 31 which in turn drives the photoconductor, against the opposing spring force of supply roller 25, by the cooperation of teeth 50 and sprocket holes 22. In this mode, the motor 60 also rotates inner core 32, desirably at a predetermined rate that will provide the desired nap thickness in the development zone.

A predetermined spaced relation is thus maintained between the image area of the photoconductor and the toner-bearing surface of outer shell 31; and, as toner is fed into the gap between the image area and the outer shell, a controlled forced contact is provided between the image area and the toner. The forced contact is compliant and highly controllable. This feature allows positive control of the photoconductor to toner spacing parameter; however, the viability of this feature is based on the fact that minimal or no relative velocity exists between the developing section of outer shell 31 and the photoconductor portion that is being developed. Should any substantial relative velocity exist, adverse effects would occur by virtue of the resulting toner movements. First a rollback of toner would occur at the gap entrance causing surface irregularities across the brush nap. Second, strong mechanical forces would be exerted between the toner and photoconductor in the gap, resulting in abrasion to the photoconductor and image smearing. As can be seen the above disclosed embodiment avoids such adverse effects, yet retains the desirable forced contact between photoconductor and toner, because the outer shell 31 drives the photoconductor 11, assuring a minimum relative velocity through the development zone.

After completion of an image cycle motor 60 is reversed and the photoconductor is driven back toward supply roller 25 against the spring force of take-up roller 26. A conventional one-way clutch mechanism is used to effect disengagement of core 32 during such reverse movement of the photoconductor.

Figure 4:
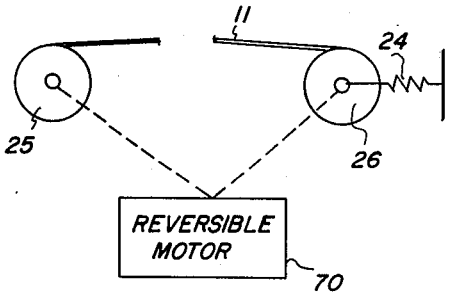
FIG. 4 is a schematic illustration of one exemplary drive means for use in the present invention.

It will be appreciated that various modifications of the above-described apparatus can be implemented in accordance with the present invention. For example, the disclosed sprocket or gear drive between the outer shell and the photoconductor could be replaced by other equivalent devices, e.g., friction or magnetic drives. Also, the photoconductor could be the driving element rather than the outer shell. In this regard, note FIG. 4, where the reversible motor 70 operates alternately on supply and take-up rollers 25 and 26.

Figure 3B:
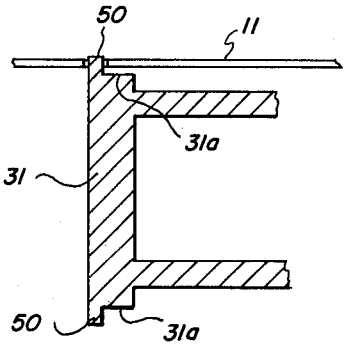
FIG. 3*b* is a view like FIG. 3*a* but showing an alternative embodiment of such structure.

Referring to FIG. 3*b* it can be seen that shell 31 can be provided with a shoulder 31*a* to positively locate the photoconductor, if, e.g., the desired photoconductor to toner spacing were not zero. This function could also be provided by proper gear tooth profile in regard to the hole size in the photoconductor.

The invention has been described in detail with particular reference to certain preferred embodiments thereof, but it will be understood that variations and modifications can be effected within the spirit and scope of the invention.

What is claimed is:

1. In electrographic apparatus of the type having an operative path along which electrographic images are developed at a development zone and transferred to a copy sheet at a transfer station, the improvement comprising:

(a) an electrographic image member having an imaging surface portion and a drive transmission portion;

(b) means for mounting said image member for movement along said path in a tensioned condition;

(c) a rotatable applicator having a transport surface for moving dry toner particles from a supply into transfer relation with said image member at said development zone and a drive transmission portion coupled with said drive transmission portion of said image member;

(d) means for providing a substantial normal force between opposing portions of said image member and said applicator ; and (e) means for driving one of said image member and applicator whereby said image member and applicator surfaces move through said development zone with a positively maintained spacial relation and a minimal relative velocity therebetween.

2. The invention defined in claim 1 wherein said drive transmission portion of said image member comprises a series of recesses therein and said drive transmission portion of said applicator comprises a series of protrusions engageable with respective recesses of said image member.

3. The invention defined in claim 1 wherein one of said image member and said applicator includes means, engageable with the other, for positively defining a nominal space therebetween.

4. The invention defined in claim 1 wherein said image member is an elongated flexible web adapted for torsional flexure toward and away from the toner transport surface of said applicator which is at said development zone.

5. The invention defined in claim 1 wherein said applicator is a magnetic brush.

6. Electrographic apparatus of the type having an operative path including a development zone and a transfer zone, said apparatus comprising:

(a) an image member having an image surface portion and drive transmission means;

(b) means for mounting said image member for movement along said path in a tensioned condition;

(c) a toner applicator member having a peripheral surface which is movable for transporting successive quantities of dry toner particles into developing relation with successive areas of said image surface portion at said development zone and including a drive transmission means engageable with said drive transmission means of said image member;

(d) means for providing a substantial normal force between opposing portion of said image member and said applicator member so as to engage said drive transmission means and positively maintain a predetermined spacial relation between said image surface portion of said image member and toner on said peripheral surface of said applicator; and (e) means for driving one of said image member and said toner applicator member whereby said image surface and said peripheral surface move with substantially zero relative velocity through said development zone.

7. The invention defined in claim 6 wherein said image member is an elongated, flexible web and the drive transmission means thereof include a series of edge notches and wherein said applicator member is a roller and the drive transmission means thereof include a series of teeth means for engaging said notches.

8. The invention defined in claim 7 wherein said roller is a magnetic brush.

9. In electrographic apparatus of the type having an operative path along which electrographic images are developed at a development zone and transferred to a copy sheet at a transfer zone, the improvement comprising:

(a) an image member comprising an elongated web having central imaging surface portions and drive transmission means extending along an edge thereof;

(b) a magnetic brush having a peripheral surface which is rotatable for transporting dry toner particles from a supply into transfer relation with said image member at said development zone and drive transmission means engageable with said drive transmission means of siad image member;

(c) means for mounting said image member for movement along said path in a tensioned condition and for urging opposing portions of said member toward said magnetic brush with a predetermined resilient force which:

(i) engages said drive transmission means and (ii) positively maintains a predetermined spacial relation between toner on said brush surface and said imaging surface portion of said image member; and (d) means for driving one of said image member and said rotatable brush surface whereby said surfaces have substantially zero relative velocity during movement through said development zone.

10. The invention defined in claim 9 wherein said drive transmission means of said image member comprise a series of recesses therein and said drive transmission means of said brush comprise a series of protrusions engageable with said recesses.

11. The invention defined in claim 9 wherein one of said image member and brush includes means, abutting the other, for positively defining a nominal space therebetween.

12. The invention defined in claim 9 wherein said image member is adapted for torsional flexure toward and away from the transport surface of said magnetic brush in said development zone.

* * * * *